United States Patent [19]

Simonis

[11] 4,240,339

[45] Dec. 23, 1980

[54] BALE PRESSING ARRANGEMENT FOR CARDBOARD WASTES

[75] Inventor: Jürgen Simonis, Wolfenbüttel, Fed. Rep. of Germany

[73] Assignee: Gebrüder Welger, Wolfenbüttel, Fed. Rep. of Germany

[21] Appl. No.: 17,082

[22] Filed: Mar. 5, 1979

[30] Foreign Application Priority Data

Mar. 8, 1978 [DE] Fed. Rep. of Germany ..... 2809887

[51] Int. Cl.[3] ..... B65B 13/20

[52] U.S. Cl. ..... 100/5; 100/7; 100/88; 100/99

[58] Field of Search ..... 56/341; 100/5, 3, 99, 100/88, 7

[56] References Cited

U.S. PATENT DOCUMENTS

| | | | |
|---|---|---|---|
| 2,096,990 | 10/1937 | Luebben | 100/1 |
| 2,589,837 | 3/1952 | McAlpine | 100/88 |
| 3,722,197 | 3/1973 | Vermeer | 100/88 X |
| 3,914,926 | 10/1975 | Braunberger | 56/341 |
| 4,121,513 | 10/1978 | Kopaska | 100/88 |
| 4,133,258 | 1/1979 | Popiolek | 100/5 |

FOREIGN PATENT DOCUMENTS

| | | | |
|---|---|---|---|
| 1248536 | 8/1967 | Fed. Rep. of Germany | 100/88 |
| 2541695 | 4/1976 | Fed. Rep. of Germany | 100/88 |

*Primary Examiner*—Billy J. Wilhite

*Attorney, Agent, or Firm*—Toren, McGeady and Stanger

[57] ABSTRACT

In pressing cardboard waste material and the like into a bale, the waste material is fed into a housing containing a pair of conveyor belts with a portion of each conveyor belt spaced from the other and forming therebetween a press chamber. The portion of the conveyor belts forming the press chamber are each driven in a different direction and the waste material is fed into the press chamber by one of the conveyor belts. As the waste material is rolled into a bale by the oppositely moving portions of the conveyor belts, the portion of the conveyor belts move outwardly away from one another increasing the volume of the press chamber and accommodating the increasing size of the bale. When the bale is completed, it is wound with a cord-like member and then one of the conveyor belts is pivoted away from the completed bale so that the bale can be displaced from the housing.

33 Claims, 7 Drawing Figures

BALE PRESSING ARRANGEMENT FOR CARDBOARD WASTES

SUMMARY OF THE INVENTION

The present invention is directed to a bale pressing arrangement for cardboard wastes and the like. By means of arrangements of this type, packaging materials of paper, cardboard or plastic are rolled into compact bales which are tied with cord and are ready to be transported.

There are known box type presses which operate intermittently and are controlled manually, however, such presses operate at low efficiencies. Continuously operating extrusion baling presses are known which operate automatically, however, such presses are economical only when large amounts of materials are being processed. Furthermore, such mechanical baling presses present problems, because they run with a lot of noise and vibrate during each piston stroke.

It is the primary object of the present invention to provide an inexpensive bale pressing arrangement for handling small and medium amounts of materials. The bale pressing arrangement is easily controlled and operates essentially automatically, further it runs with only a small amount of noise, requires little space and has a high throughput efficiency.

In accordance with the present invention, a pair of conveyor belt units are combined to form a press chamber located within a housing so that waste materials fed into the housing can be rolled into a bale by the cooperating action of the conveyor belt units. By means of the invention it is possible to provide a tightly rolled cylindrical bale of waste material, such as is known from agricultural harvesting equipment, and allows a high efficiency with a simple waste material feeding method. The pressing arrangement operates completely without vibration and extremely quietly and, further, its power requirement is low. After a bale is rolled, it is tied with cord by an automatic device having a relatively simple structure. The removal of completed bales and the transportation of such cylindrical bales is easy and simple.

A particularly advantageous feature of the invention is the use of one of the conveyor belts forming the press chamber as the means for feeding the material into the chamber. A portion of one of the conveyor belts forming the press chamber extends upwardly above the chamber and forms part of the feed inlet chamber and presses bulky materials into a flat layer and feeds the layer through a feed slot into the press chamber. This arrangement simplifies not only the means for driving the conveyors, but the entire structural arrangement and maintenance of the arrangement. Furthermore, this arrangement reduces the possibility of any operational problems which would occur where several successive conveying elements are used. The use of a single conveyor belt as the feed member and as a part of the press chamber avoids the significant problem that the waste material might escape between two adjacent conveyor belts or conveyor rollers.

Moreover, the bale pressing arrangement which combines the feeding and pressing functions in a single unit ensures an equal waste material feeding and rolling speed which is essential in materials which are unyielding in feed direction. If the feed is too slow, slippage occurs in the press chamber, while if the feed is too fast, it causes a jam in the feed inlet.

A critical problem in the baling of cardboard material is the starting of each roll baling operation. It must be insured to roll up the material being deflected by means of the conveyor belts and to prevent the material from emerging from the inlet of the press chamber. This problem is overcome bu positioning a deflection roller at the inlet to the press chamber between the adjacent surfaces of the conveyor belts forming the inlet side of the chamber.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred emodiments of the invention.

DETAIL DESCRIPTION OF THE INVENTION

Figure 1:
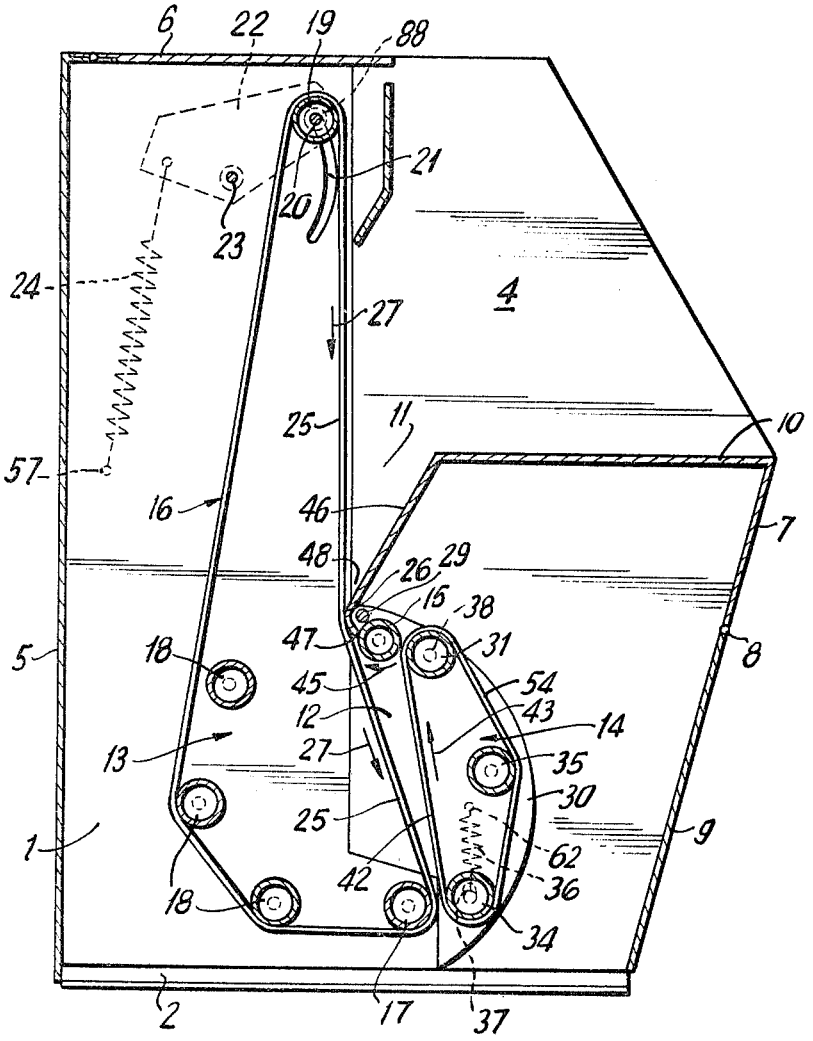
FIG. 1 is a sectional side view through the middle of a bale pressing arrangement embodying the present invention.

In the drawings, a housing 1 is mounted on two bottom girders 2 and includes a pair of upwardly extending supporting side walls 3, 4. Note in FIG. 1 only side wall 4 is shown, while in FIG. 4 the spaced relation of the side walls is illustrated. An upwardly extending rear wall 5 extends across the rear edges of the side walls 3 and 4 and an upper cover 6 forms a top closure for the housing. At the opposite side of the housing from the rear wall 5, a front wall 7 extends upwardly from the bottom girders 2 to a point approximately halfway between the bottom girders and the upward cover 6. A portion of the front wall 7 forms a bale removal flap 9 pivotally mounted on hinges 8. Waste material is fed over a horizontally arranged table 10 extending across the width of the housing between the side walls 3 and 4 and extending from the upper end of the front wall 7 inwardly toward the rear wall 5. At a position spaced inwardly from the front wall 7, the table 10 terminates in an inlet chamber 11.

Within the housing, below the table 10 and the inlet chamber 11, is a rolling press chamber 12. The rolling press chamber 12 is formed on one side by a first conveyor belt unit 13 and on its other side by a pivotally mounted second conveyor belt unit 14. Further, the upper end of the chamber 12 includes a deflection roller 15 located between the two conveyor belt units.

The first conveyor belt unit 13 includes an endless first conveyor belt 16 with entrainment means. The first conveyor belt 16 is trained around a lower driven belt roller 17, three rear belt rollers 18 and an upper tensioning roller 19. The driven belt roller 17 and the rear belt rollers 18 are rigidly supported in the side walls 3, 4.

The tensioning roller 19 has a shaft 20 which extends through a circular arc slot 21 in each of the side walls 3 and 4 and is supported in cambered roller bearings 88 in a pair of two-armed levers 22 each located on the exterior of one of the side walls 3, 4. The levers are supported on a shaft 23 extending through the housing and the shaft is spaced between the first conveyor belt 16 and the rear wall 5 of the housing. The levers pivot on the shaft 23 and a tension spring 24 is assigned to each of the levers for biasing the tensioning roller 19 into the upper end of the slots 21. As shown in FIG. 1, each tensioning spring is attached to the end of the lever 22 on the opposite side of the shaft 23 from the tensioning roller 19. The lower end of one of the tensioning springs is attached to the housing at a pivot pin 57, the other one near this pivot pin 57 at a lever 56, note FIG. 2.

The endless first conveyor belt 16 includes a first belt portion 25 extending from the tensioning roller 19 downwardly to the driven roller 17. Initially, the first belt portion 25 extends perpendicularly downwardly to an inlet edge 26 which it contacts when the rolling press chamber 12 is empty, as shown in FIGS. 1 and 5. Below that point, the first belt portion 25 extends obliquely downwardly to the driven belt roller 17, the roller 17 is located closer to the front of the housing 1 than the tensioning roller 19. The first conveyor belt 16 is driven in the direction of the arrow 27 moving downwardly from the tensioning roller 19 through the inlet chamber 11 and then forming a portion of the press chamber 12 before passing around the driven belt roller 17. The first conveyor belt 16 extends around the roller 17 over the lowermost one of the rear rollers 18 and then moves upwardly over the rear rollers of the tensioning roller 19. The roller 17 is driven by a chain wheel 28, note FIGS. 2 and 4.

Second conveyor belt unit 14, note FIG. 1, is supported in the housing 1 so that it can be pivoted about shaft 29. The second conveyor belt unit 14 includes a pair of second side walls 30 arranged in parallel with the side walls 3 and 4, with a driven belt roller 31, a belt tensioning roller 34 and a rear belt roller 35 extend transversely between and supported in the second side walls 30. Belt tensioning roller 34 extends at its opposite ends into longitudinal slots 37 in the side walls 30 and belt tensioning roller is biased downwardly in the slots by springs 36, attached to the side walls 30 at pins 62. Driven belt roller 31 has a shaft 38, note FIG. 2, on which a spur wheel 39 is mounted which meshes in turn with a second spur wheel 40. The second spur wheel is coaxially connected to a chain wheel 41 located laterally of the driven belt roller 31 and is mounted on the shaft 29. A second endless conveyor belt 54 completes the second conveyor belt unit 14 and is trained around the driven belt roller 31, the belt tensioning roller 34 and the rear belt roller 35. The second conveyor belt 54 travels in the direction of the arrow 43 with the portion 42 located in the press chamber 12 of the belt moving in the opposite direction relative to the portion 25 of the first belt conveyor 16.

When the bale pressing arrangement is empty, the press chamber 12 is wedge-shaped and is defined by the portions 25, 42 of the first conveyor belt 16 and the second conveyor belt 54, respectively. The wider end of the press chamber 12 is at the top while its pointed end is at the bottom between the closely adjacent belt rollers 17 and 34 of the first and second conveyor belt units. As can be seen in FIG. 1, the upper end of the press chamber 12 has the conveyor belt portions 25, 42 in spaced relation with the deflection roller 15 between them. In other words, in the empty state, the press chamber 12 is defined by the belt portion 25 of the first conveyor belt unit 13, the belt portion 42 of the second conveyor belt unit 14 and the deflection roller 15. The deflection roller 15 is located closely below the shaft 29. The jacket or outer surface of the deflection roller is formed of a rubber material. The deflection roller 15 is driven by a chain drive 44 from shaft 38 of the driven roller 31 in the second conveyor belt unit 14 and the deflection roller rotates so that its surface forming the upper end of the press chamber forms a continuation of the movement provided by the belt portions 25, 42. It can be noted in FIG. 1, that the belt portion 25 forming a part of the press chamber moves downwardly while the belt portion 42 moves upwardly and the surface of the deflection roller, note arrow 45, moves in the direction from the belt portion 42 to the belt portion 25.

The feeding or inlet chamber 11 extends across the width of the housing between the side walls 3, 4 and is defined by the vertically extending section of belt portion 25 above the press chamber 12 and by guide wall 46 which extends obliquely downwardly from the material feeding table 10 toward the belt portion 25. As can be seen in FIG. 1 the inlet chamber has a generally V-shaped appearance. The guide wall 46 extends downwardly into line contact with the belt portion 25 and at the location of line contact the guide wall has a slightly rounded surface 26. From the location of the line contact with the conveyor belt portion 25, the guide wall 46 extends downwardly with its edge adjacent to the deflection roller 15 forming a strippr 47. The lower part of the guide wall 46 which forms the rounded inlet edge 26 and the stripper 47 is constructed as a separate piece and is attached to the guide wall 46 by screws so that the stripper 47 can be adjusted. Between the inlet edge 26 into the press chamber 12 and the conveyor belt portion 25 a feed slot 48 is provided at the lower portion of the inlet chamber 11 which presses flat the waste material as it enters the press chamber. As can be appreciated, the above description refers to the bale pressing arrangement when the press chamber is empty, as material is fed into the press chamber, the feed slot 48 increases in dimension between the lower end of the guide wall 46 and the belt portion 25, compare FIGS. 5 and 6.

Figure 2:
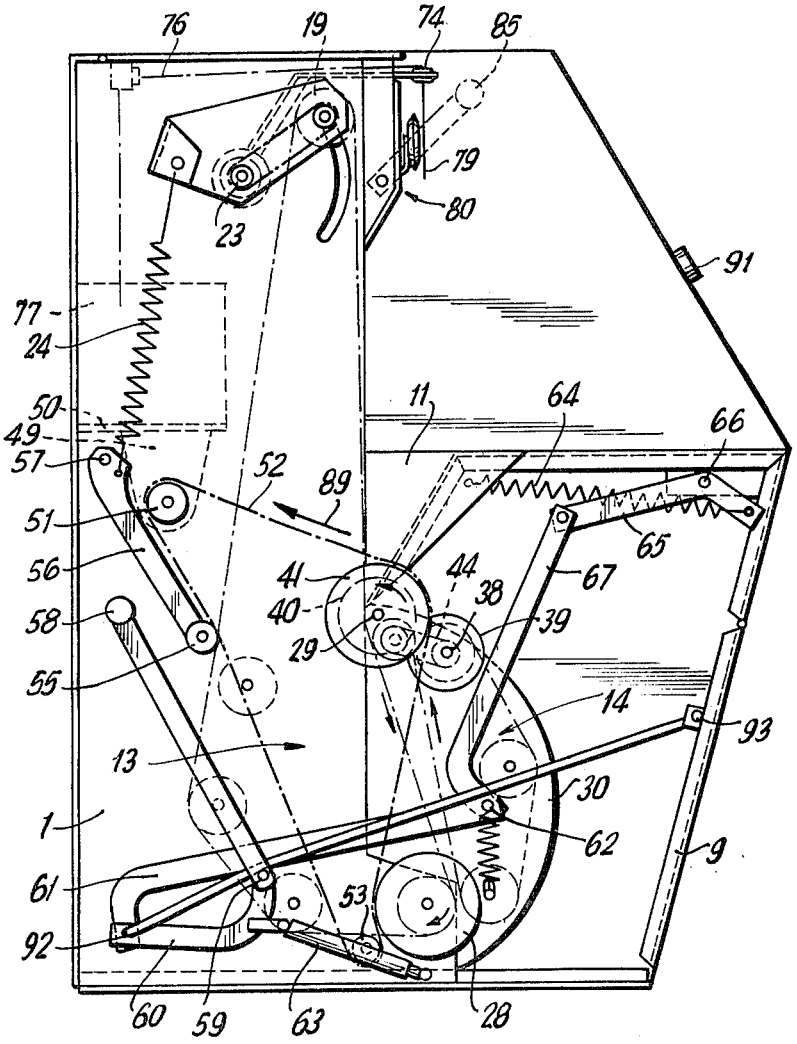
FIG. 2 is a side view of the bale pressing arrangement shown in FIG. 1.
Figure 3:
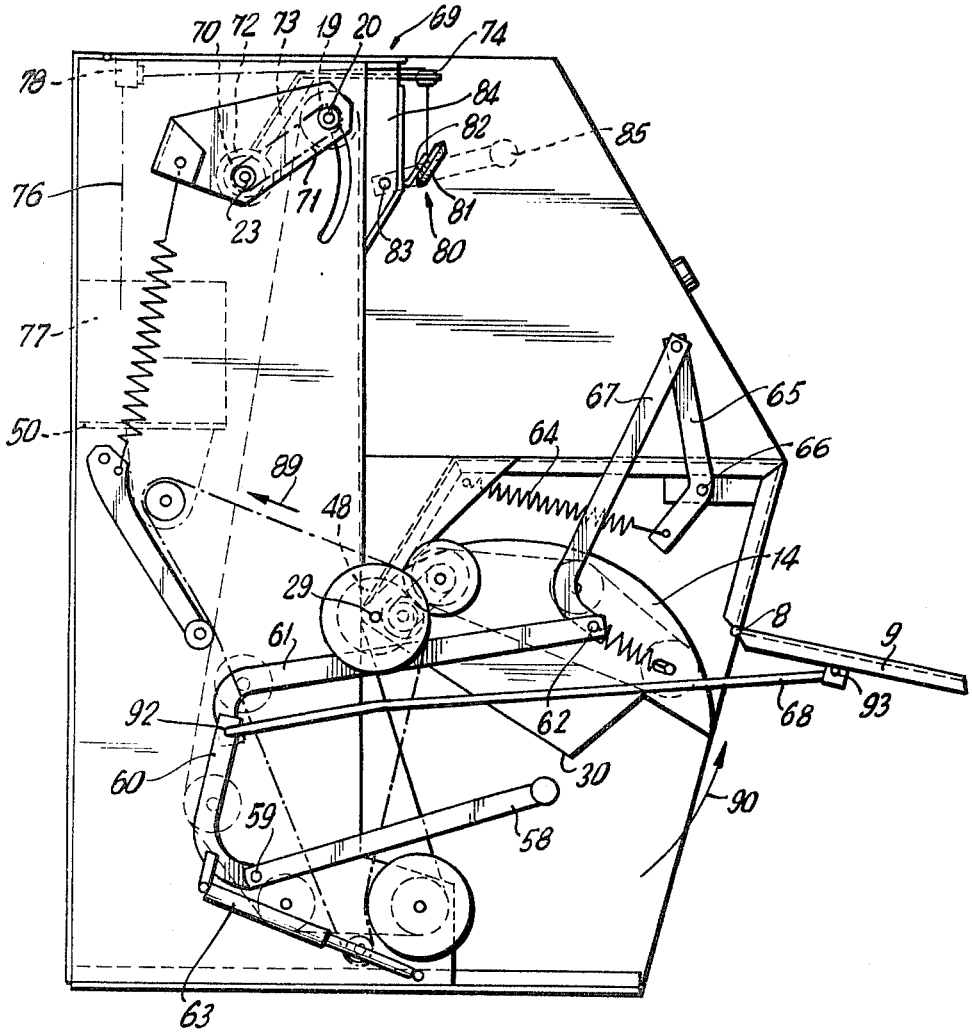
FIG. 3 is a view similar to FIG. 2, however, with the press chamber shown in the open position.
Figure 4:
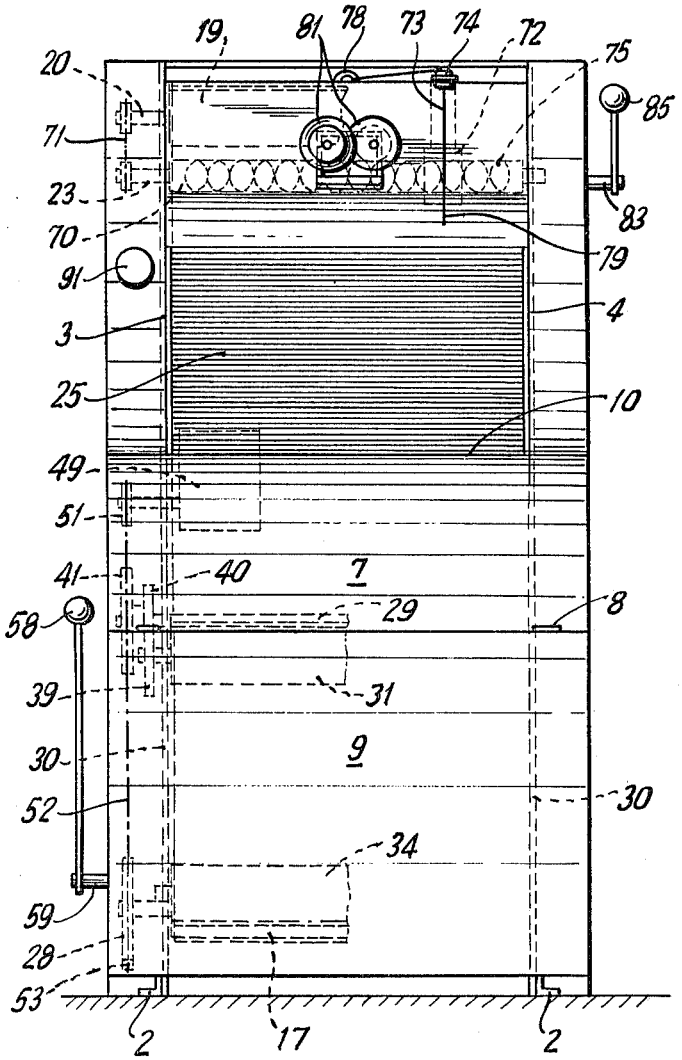
FIG. 4 is a front view of the bale pressing arrangement.
Figure 5:
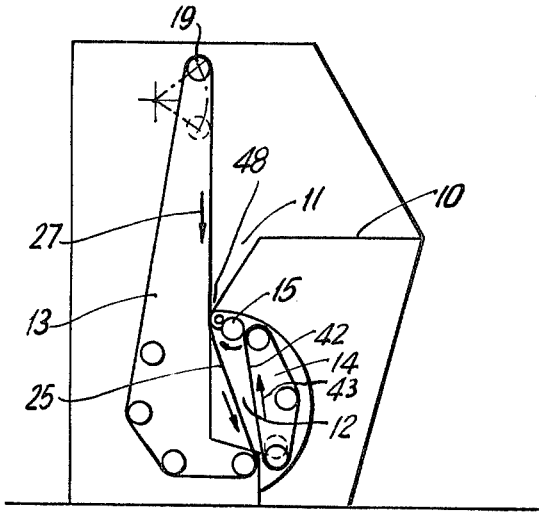
FIGS. 5, 6 and 7 are schematic side views showing the sequential operational positions of the bale pressing arrangement illustrated in FIGS. 1–4.

Conveyor belts 16, 54 are driven by an electric gear motor 49 mounted on a bracket 50, note FIGS. 2 and 4. As shown in FIGS. 2, 3 and 4, the motor 49 drives a chain wheel 51 and a chain 52 is guided around the chain wheel downwardly to the chain wheel 28 of the first conveyor belt unit 13 with the outer side of the chain 52 guided over the chain wheel 28 while its inner side moves around the chain wheel 41 of the second conveyor belt unit 14. The chain wheel 41 is located upwardly from the chain wheel 28. Accordingly, the chain 52 travels in the direction of the arrow 89 and causes a torque to act on the pivotal conveyor belt unit 14 so that it is biased to pivot in the upward direction, note arrow 90 in FIG. 3. The chain 52 is slightly tensioned by a chain tensioning wheel 55 supported on a pivotally mounted lever 56. One of the springs 24 attached to the lever 22 is connected to the lever 56 near its pivot pin 57.

Second conveyor belt unit 14, which is closed during the formation of a rolled bale, that is, it forms one side of the press chamber, can be pivoted upwardly by means of a hand lever 58, note FIG. 3. Hand lever 58 is supported on a shaft 59 extending between the lower ends of the first side walls 3 and 4. The shaft 59 is rigidly connected to two levers 60 each of which is connected to an elongated coupling bar 61. Each bar is connected by a pin 62 to one of the second side walls 30. This mechanism for opening and closing the second conveyor belt unit 14 is stabilized to two shock absorbers 63 each connected at one end to the housing 1 and at the other end to one of the levers 60. The pivotal movement effected by this mechanism is facilitated by two counterweight springs 64. Each of the counterweight springs 64 is connected at one end to the housing 1 and at the other end to one end of a two-armed lever 65 which is mounted between the two arms on a bolt 66 secured to the housing 1. A coupling bar 67 is connected to each two-armed lever 65 at the opposite end from the connection of the spring 64 and the other end of the coupling bar is fitted onto one of the pins 62 in the side walls 30. Furthermore, a rod 68 forms a pin 92 at one end connecting one lever 60 to one coupling bar 61. The other end of the rod 68 forms a pin 93 which is connected to the bale removal flap 9. To close the second conveyor belt unit 14 and the bale removal flap 9, the coupling bars 61 joined to the levers 60 at the pin or pivot joint 92 must be guided through a stretched position which extends in a straight line through the pivot joints 92, 59 and 62, note FIG. 2. By virtue of this arrangement, a tight closure is guaranteed for the second conveyor belt unit 14 in the operating position. The torque of the chain wheel 41 which biases the second belt unit 14 in the pivot direction indicated by the arrow 90, assists its opening in the first stage of pivoting upwardly. Furthermore the said torque prevents any unintended closing of the second conveyor belt unit 14, when it is opened and the bale pressing arrangement is running.

Figure 7:
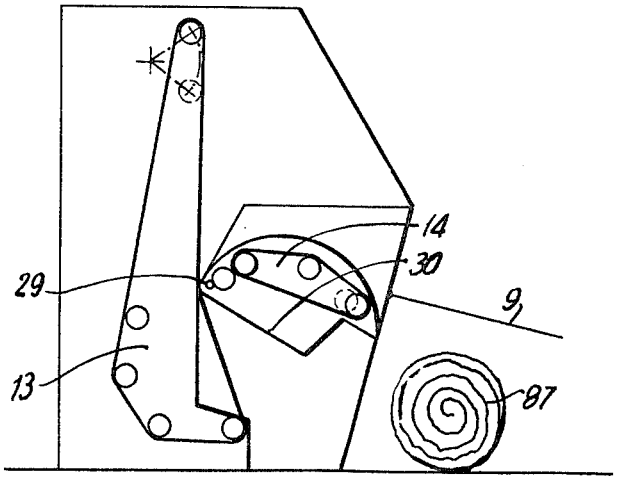

To facilitate the ejection of a completed bale and to prevent large clamping forces by the first side walls 3, 4 from acting on the bale in the press chamber, the second side walls 30 of the second conveyor belt unit 14 are shaped to cover about half of the end cross-section of the bale. Since the second side walls 30 are pivoted upwardly with the second conveyor belt unit 14 when it is moved to the open position, any remaining friction between the first side walls 3, 4 and the bale can be easily overcome by the first conveyor belt portion 25 which, with the second conveyor belt unit 14 displaced to the open position shown in FIG. 7, returns to its original position, note FIGS. 5 and 7, displacing the bale 87 outwardly with the belt section located outwardly from the adjacent edges of the first side walls 3, 4.

Mounted on the housing 1 above the inlet chamber 11 is a device 69 for tying the bale of waste material rolled in the press chamber 12. Device 69 includes a reverse-thread spindle 70 extending across the housing between the first side walls 3, 4. The shaft 23 supports the spindle 70 and the spindle is continuously driven by a chain drive 71 from the adjacent upper tensioning roller 19. A cord guide member 72 is axially movably supported on the spindle 70. The guide member 72 is constructed as a hollow cylinder ring from which a guide arm 73 extends above the tensioning roller 19 toward the front side of the housing. The end of guide arm 73 spaced outwardly from the guide member 72 terminates in a guide ring 74 located above the inlet slot 48 in the lower end of the inlet chamber 11. The guide member 72 engages a guide cam with the winding groove 75 of the reverse-thread spindle 70, so that the guide ring 74 is moved back and forth over the inlet slot 48 between the first side walls 3, 4. A storage container 77 for a cord-like member is mounted on the bracket 50, note FIG. 3, and a strand 76 of the cord-like member is guided from the container 77 upwardly through a guide ring 78 and then laterally to the guide ring 74. In position for use, the end 79 of the cord-like strand 76 is located in position directly above the inlet chamber 11, note FIG. 2.

Below the path of travel of the guide ring 74 and approximately in the middle of the housing between the side walls 3, 4, a cutting device 80 is positioned. The cutting device 80 includes two circular disc knives 81 supported on a plate 82 so that the knives rotate freely and overlap one another and, further, the cutting edges of the disc knives rest against one another. The support plate 82 is rotatably supported on a shaft 83 in a bracket 84. A hand lever 85 is secured to the shaft 83 and by manipulating the hand lever 85 the shaft can be turned so that the circular disc knives are locked in a vertical rest position, FIG. 2, or are swung into an obliquely extending cutting position, note FIG. 3, in the path of the strand 76 moving downwardly toward the inlet chamber 11.

Figure 6:
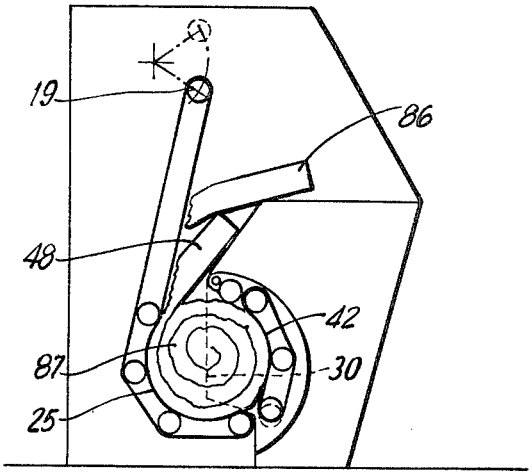

The bale pressing arrangement operates as follows: with the electric gear motor running and driving the chain 52, and with the press chamber 12 closed in the empty position as shown in FIG. 1, cardboard waste 86 is moved over the feed table 10 against the first conveyor belt portion 25 which extends vertically and moves in the direction of the arrow 27 so that the waste is moved downwardly into the inlet chamber 11. As the waste moves downwardly in the inlet chamber 11, it is pressed flat in the inlet or feed slot 48 and then is conveyed by the first conveyor belt portion 25 into the press chamber 12. In FIG. 6 the waste material 86 is shown moving downwardly into the press chamber and being rolled into a bale 87. Within the press chamber 12, the second conveyor belt portion 42 is driven in the direction of the arrow 43 and causes the material to bend and to be fed upwardly toward the deflection roller 15. At the deflection roller 15, the material is directed toward the first conveyor belt portion 25 where it is again directed downwardly. As a result of the movement imparted to the waste material by the first conveyor belt portion 25 and the second conveyor belt portion 42 and also by the deflection roller 15 a roll of the waste material is formed and increases in diameter as more material is introduced into the press chamber 12 from the inlet chamber 11. The continuous rolling action forms the bale 87 shown in FIG. 6. As the roll or bale of material increases in diameter, the first conveyor belt portion 25 and the second conveyor belt portion 42 start to move outwardly away from one another to accommodate the bale until the outwardly directed surfaces of the portions 25, 42 contact the first and second rear belt rollers 18, 35. The cambered roller bearings 88 allow the adjustment of the first conveyor belt 16 even for non-uniform bales.

When the rolled bale 87 has reached the intended size and compressed density, which is indicated by an electric current meter or ampere meter 91 mounted on the housing, note FIG. 2, the material feed is stopped and the end 79 of the cord-like member 76 is pulled manually downwardly into the inlet slot 48. The end 79 is grasped between the first conveyor belt portion 25 and the surface of the bale and as the conveyor belts continue to operate, the yarn is wound spirally around the bale 87. To cut the strand 76 after enough of the cord-like member has been applied, the cutting device 80 is moved into the operating position shown in FIG. 3 by means of the hand lever 85.

With the completed bale wrapped with the strand of the cord-like member, the hand lever 58 is moved to the position shown in FIG. 3 and the second conveyor belt unit 14 is pivoted in the direction of the arrow 90 away from the completed bale and the bale removal flap 9 is moved into the open position. Accordingly, the completed bale 87 is ejected through the opened front of the housing 1 by means of the first conveyor belt 16. The rolled bale is ready for transport after the free end of the cord-like member strand 76 has been clamped under a winding of the strand.

It is possible that other conveying members besides belts could be used in a specific embodiment of the invention.

While specific embodiments of the invention have been shown and described in detail to illustrate the application of the inventive principles, it will be understood that the invention may be embodied otherwise without departing from such principles.

What is claimed is:

1. Bale pressing arrangement for cardboard waste and the like comprising a housing, said housing having an inlet for introducing material to be baled into said housing, a first conveyor belt unit located in said housing and including a plurality of spaced first rollers and an endless first conveyor belt traveling around said first rollers, a second conveyor belt unit located in said housing spaced from said first conveyor belt unit and including a pluraity of spaced second rollers and an endless second conveyor belt traveling around said second rollers, said first conveyor belt including an upwardly extending first portion, said second conveyor belt including an upwardly extending second portion with the surface of said second portion facing toward and spaced from the surface of said first portion of said first conveyor belt and forming therebetween a press chamber, means for driving said first and second conveyor belts so that said first portion and second portion forming said press chamber travel in opposite directions, said first conveyor belt supported by said first rollers and said second conveyor belt supported by said second rollers so that the first portion of said first conveyor belt and the second portion of said second conveyor belt move away from each other in the direction transverse to the direction of movement of said first and second conveyor belts for increasing the volume of said press chamber as the amount of waste material introduced into said press chamber is increased, said press chamber having a first end and a second end with the ends extending transversely of the direction of movement of said first and second belt conveyors and said first end spaced upwardly from said second end, at said first end said first and second belt conveyors being disposed in spaced relation and at least said first belt conveyor forming one side of an inlet opening for introducing the waste material into said press chamber at said first end thereof, said first conveyor belt extending generally upwardly from said inlet opening at said first end of said press chamber and forming a continuation of said first portion thereof, and means in combination with said continuation of said first portion forming an inlet chamber for supplying the material to be baled downwardly through said inlet opening into said first end of said press chamber.

2. Bale pressing arrangement, as set forth in claim 1, including means for pivotally supporting said second conveyor belt unit within said housing so that when a completed bale is formed in said press chamber said second conveyor belt can be pivoted outwardly from the completed bale and the bale can be displaced from said press chamber.

3. Bale pressing arrangement, as set forth in claim 2, wherein said housing includes a pair of first side walls extending transversely of the surfaces of said first and second conveyor belts and spaced outwardly from and closely adjacent the edges of said first and second conveyor belts, and said first rollers supported in said first side walls.

4. Bale pressing arrangement, as set forth in claim 3, wherein means are mounted on said housing for supplying a strand of a cord-like member through said inlet opening into said press chamber for cooperating with said first and second conveyor belts for wrapping the strand around a completed bale.

5. Bale pressing arrangement, as set forth in claim 4, wherein said means for supplying the strand of said cord-like member includes a guide positioned above the inlet into said housing, and means for moving said guide in a straight line between said first side walls above said inlet.

6. Bale pressing arrangement, as set forth in claim 5, wherein said means for moving said guide comprises a reverse-thread spindle for moving said guide back and forth over said inlet.

7. Bale pressing arrangement, as set forth in claim 6, wherein a cutter for the strand of said cord-like member is pivotally mounted on said housing between said first side walls and below said guide, and a hand lever attached to said cutter for moving said cutter into and out of the path of movement of the strand between said guide and said inlet.

8. Bale pressing arrangement, as set forth in claim 7, wherein said cutter comprises two overlapping freely rotating circular disc knives.

9. Bale pressing arrangement, as set forth in claim 3, wherein said first portion of said first conveyor belt and said second portion of said second conveyor belt converge toward one another in the downward direction from the first end to the second end of said press chamber when said press chamber is empty so that said press chamber, when empty, is wedge-shaped in a plane parallel to the plane of said first side walls of said housing.

10. Bale pressing arrangement, as set forth in claim 9, wherein said means forming said inlet chamber includes a guide wall extending between said first side walls above said second conveyor belt unit, said guide wall extending generally upwardly from the first end of said press chamber, and said guide wall being in diverging relationship with the continuation of said first portion of said first conveyor belt above the first end of said press chamber.

11. Bale pressing arrangement, as set forth in claim 10, wherein the lower part of said guide wall immediately above said first end of said press chamber is in line contact with said first conveyor belt when said press chamber is empty, and below the line of contact between said first conveyor belt and said guide wall said guide wall extends downwardly in diverging relation with said first portion to its lower end with the lower end located adjacent said deflection roller so that said guide wall below the line of contact with said first conveyor belt forms a stripper for material being rolled into a bale within said press chamber.

12. Bale pressing arrangement, as set forth in claim 11, wherein said housing includes a wall-like portion forming a horizontal table extending from the upper end of said guide wall outwardly in the direction away from said first conveyor belt so that waste material can be introduced inwardly over said table into the space between said guide wall and said first conveyor belt for movement downwardly by the action of said first conveyor belt into said press chamber.

13. Bale pressing arrangement, as set forth in claim 12, wherein said first conveyor belt above said first end of said press chamber and between the point of line contact with said guide wall and said first tensioning roller when said press chamber is empty, extends perpendicularly to the plane of said horizontal table.

14. Bale pressing arrangement, as set forth in claim 12, wherein said housing includes a flap located below the outer end of said table and located adjacent said second conveyor belt unit, said flap being pivotally mounted on said housing so that it can be pivoted outwardly permitting the pivotal movement of said second conveyor belt unit whereby a completed bale can be displaced from said housing.

15. Bale pressing arrangement, as set forth in claim 3, wherein a deflection roller is positioned in and extends across the first end of said press chamber in the direction between said first side walls and also between said first and second conveyor belts and forms a closure for the press chamber when the press chamber is empty, and means for driving said deflection roller so that it continues to roll the waste material within the press chamber in the same direction as provided therein by said first and second conveyor belts.

16. Bale pressing arrangement, as set forth in claim 3, wherein means are associated with each of said first and second conveyor belt units for tensioning each of said first and second conveyor belts so that in opposition to the tensioning effect said first and second conveyor belts can move outwardly from one another in the range of said press chamber.

17. Bale pressing arrangement, as set forth in claim 16, wherein said first rollers include a first driven roller located at the second end of said press chamber, a first tensioning roller located above said first end of said press chamber and at least one first rear roller spaced from said driven first roller and located below the first end of said press chamber, when said press chamber is empty said first conveyor belt runs over said first driven roller said at least one first rear roller and said tensioning roller, and an additional first rear roller located above said at least one rear roller in the vertical range of said press chamber whereby as waste material is filled into said press chamber and rolled into a bale the surface of said first portion of said first conveyor belt facing away from said press chamber moves gradually outwardly toward said at least one rear roller and said additional rear roller, with said first driven roller said at least one rear roller and said additional rear roller forming a support for the surface of said first portion of said first conveyor belt facing away from said press chamber when a completed bale is located in said press chamber.

18. Bale pressing arrangement, as set forth in claim 17, wherein said second rollers comprise a second driven roller located at said first end of said press chamber, a second tensioning roller located at the second end of said press chamber and a second rear roller spaced outwardly from said second portion of said second conveyor belt when said press chamber is empty with said second conveyor belt moving upwardly from the second end of said press chamber around said second tensioning roller to the first end of said press chamber where it passes around said second driven roller and then moves downwardly passing around said second rear roller returning to said second tensioning roller, whereby as waste material is filled into said press chamber and rolled into a bale the surface of said second portion of said second conveyor belt which faces outwardly away from said press chamber moves gradually outwardly toward said second rear roller, with said second driven roller said second rear roller and said second tensioning roller forming supports for the outwardly facing surface of said second portion of said second conveyor belt when a completed bale is located in said press chamber.

19. Bale pressing arrangement, as set forth in claim 18, wherein said means for pivotally supporting said second conveyor belt unit comprises a pair of second side walls located on opposite sides of said housing in generally spaced parallel relation with each other and each of said second side walls being adjacent one of said first side walls, a shaft supported in said housing and extending between said second side walls adjacent said first end of said chamber, said second side walls being pivotally mounted on said shaft and said second rollers extending between and supported in said second side walls, said second side walls being pivotally displaceable between a first position where said second conveyor belt forms one side of said press chamber and a second position where said second conveyor belt and said second rollers are pivoted with said second side walls outwardly away from said first conveyor belt so that a completed bale can be removed from said press chamber.

20. Bale pressing arrangement, as set forth in claim 19, wherein a hand lever assembly is mounted on one of said side walls and is connected to each of said second side walls for pivoting said second side walls and the remainder of said second conveyor belt unit mounted thereon between the first and second positions thereof.

21. Bale pressing arrangement, as set forth in claim 20, wherein said hand lever assembly comprises a hand lever shaft extending through and supported in said first side walls, a hand lever secured to one end of said hand lever shaft on the exterior of one of said side walls, and lever means interconnecting said hand lever shaft and said second side walls for pivoting said second side walls.

22. Bale pressing arrangement, as set forth in claim 17, including means for tensioning said first tensioning roller for maintaining said first portion of said conveyor belt tensioned as waste material is fed by said first conveyor belt into said press chamber.

23. Bale pressing arrangement, as set forth in claim 22, wherein said means for tensioning said first tensioning roller comprises a generally upright arcuate slot in each of said first side walls adjacent said first tensioning roller, said first tensioning roller including a lever shaft extending outwardly through said arcuate slots and spaced from said arcuate slots in the direction extending transversely of said arcuate slots, a lever secured to each end of said lever shaft intermediate the opposite ends thereof with one end of said lever being connected to said lever shaft for said first tensioning roller, a tension spring secured to each said first side wall and to the opposite end of each said lever for biasing said first tensioning roller to the upper end of said arcuate slots.

24. Bale pressing arrangement, as set forth in claim 18, wherein said means for driving said first and second conveyor belts comprises a drive member, said drive member drives said first driven roller, a wheel located adjacent to and spaced laterally from said second driven roller, a first spur wheel coaxially mounted on said wheel, said drive member driving said wheel und thereby said first spur wheel, a second spur wheel mounted on said second driven roller, said first spur wheel meshes with said second spur wheel and drives said second driven roller, and the driving action from said wheel through said first spur wheel to said second spur wheel biases said second conveyor belt unit for pivotable movement in the direction from the first to the second position thereof.

25. Bale pressing arrangement, as set forth in claim 24, wherein said means for driving said first and second conveyor belts comprises an electric gear motor, said drive member is a chain driven by said gear motor.

26. Bale pressing arrangement, as set forth in claim 25, wherein an electric measuring device is mounted on said housing in connection with said electric gear motor and measures the power consumption of said motor and indicates the pressing density within said press chamber and the attainment of the safe pressing load.

27. Bale pressing arrangement for cardboard waste and the like comprising a housing, a first conveyor belt unit supported within said housing, a second conveyor belt unit pivotally supported within said housing, said first conveyor belt unit including an endless first conveyor belt and first supporting means for said first conveyor belt, said second conveyor belt unit including an endless second conveyor belt and second supporting means for said second conveyor belt, said first conveyor belt having an upwardly extending first portion and said second conveyor belt having an upwardly extending second portion disposed in opposite spaced relation to said first portion of said first conveyor belt with said first and second portions forming therebetween a press chamber having a first end through which waste material is fed into said chamber and an opposite second end, said first end of said press chamber spaced upwardly from said second end, means for driving said first and second conveyor belts so that said first portion moves in an opposite direction to said second portion within said press chamber, said press chamber having an empty state and a filled state when the waste material fed thereto is rolled into a completed bale, and said first and second portions being movable outwardly from one another as the waste material is fed into and rolled within said press chamber until said press chamber reaches the filled stage, at said first end of said press chamber said first and second portions being disposed in spaced relation and at least said first belt conveyor forming one side of an inlet opening into said press chamber at said first end thereof, said first conveyor belt extending generally upwardly from said inlet opening at said first end of said press chamber and forming a continuation of said first portion thereof, and means in combination with the continuation of said first portion forming an inlet chamber for supplying the material to be baled downwardly through said inlet opening into said first end of said press chamber.

28. Bale pressing arrangement, as set forth in claim 27, wherein said second conveyor belt unit is pivotally movable outwardly from a completed bale within said press chamber so that said completed bale can be removed from said press chamber.

29. Bale pressing arrangement, as set forth in claim 28, wherein said means forming said inlet chamber includes said housing and a guide wall opposite said continuation of said first portion of said first conveyor belt.

30. Bale pressing arrangement for cardboard waste and the like comprising a housing, a first conveyor unit supported within said housing, a second conveyor unit pivotally supported within said housing, said first conveyor unit including a first conveyor means for conveying waste material and first supporting means for said first conveyor means, said second conveyor unit including a second conveyor means for conveying waste material and second supporting means for said second conveyor means, said first conveyor means having an upwardly extending first portion and said second conveyor means having an upwardly extending second portion disposed in opposite spaced relation to said first portion of said first conveyor means with said first and second portions forming therebetween a press chamber having a first end through which waste material is fed into said chamber and an opposite second end, said first end of said press chamber being spaced upwardly from said second end, means for driving said first and second conveyor means so that said first portion moves in an opposite direction to said second portion within said press chamber, said press chamber having an empty state and a filled state when the waste material fed thereto is rolled into a completed bale, said first and second portions being movably displaceable outwardly from one another as the waste material is fed into and rolled within said press chamber until said press chamber reaches the filled state, at said first end of said press chamber said first and second portions being disposed in spaced relation and at least said first belt conveyor forming one side of an inlet opening into said press chamber at said first end thereof, said first conveyor belt extending generally upwardly from said inlet opening at said first end of said press chamber and forming a continuation of said first portion thereof, means in combination with the continuation of said first portion forming an inlet chamber for supplying the material to be baled downwardly through said inlet opening into said first end of said press chamber.

31. Bale pressing arrangement, as set forth in claim 30, wherein said first conveyor means is a first endless conveyor belt and said second conveyor means is a second endless conveyor belt.

32. Bale pressing arrangement, as set forth in claim 30, wherein said second conveyor unit is pivotally movable outwardly from a completed bale within said press chamber so that said completed bale can be removed from said press chamber.

33. Bale pressing arrangement, as set forth in claim 32, wherein said means forming said inlet chamber include said housing and a guide wall opposite said continuation of said first portion of said first endless conveyor in combination with said first endless conveyor form said inlet chamber for the waste material.

* * * * *